United States Patent [19]

Folkins et al.

[11] Patent Number: 4,868,607

[45] Date of Patent: Sep. 19, 1989

[54] ELECTROPHOTOGRAPHIC DEVICE WITH A BEAD PICKOFF ARRANGEMENT

[75] Inventors: Jeffrey J. Folkins, Rochester, N.Y.; Morton Silverberg, Westport, Conn.

[73] Assignee: Xerox Corporation, Stamford, Conn.

[21] Appl. No.: 187,787

[22] Filed: Apr. 29, 1988

[51] Int. Cl.[4] ..... G03G 21/00

[52] U.S. Cl. ..... 355/269; 118/652; 355/296

[58] Field of Search ..... 355/3 DD, 15; 118/652, 118/653

[56] References Cited

U.S. PATENT DOCUMENTS

| | | | |
|---|---|---|---|
| 3,834,804 | 9/1974 | Bhagat et al. | 355/3 R |
| 3,894,513 | 7/1975 | Stanley et al. | 118/637 |
| 4,190,351 | 2/1980 | Macaluso et al. | 355/15 |
| 4,210,397 | 7/1980 | Macaluso et al. | 355/15 |
| 4,349,270 | 9/1982 | Wada et al. | 355/15 |
| 4,552,451 | 11/1985 | Yamazaki et al. | 355/15 |

FOREIGN PATENT DOCUMENTS 59-94776 5/1984 Japan .

*Primary Examiner*—Fred L. Braun
*Attorney, Agent, or Firm*—Mark Costello

[57] ABSTRACT

A carrier bead pickoff device for removal of carrier beads adhering to a charge retentive surface in an electrophotographic device having at least one developer housing movable into and out of developing position includes a magnet supported on the movable developer housing of the type which is movable into and out of developing position with respect to the photoreceptor. When the developer housing is moved into developing position, the magnet is correspondingly brought into a position closely adjacent to a non-magnetic carrier bead catch supported closely adjacent to the charge retentive surface. Beads are collected at the bead catch and released upon removal of the magnet from proximity to the bead catch. The non-magnetic bead catch may be supported for movement into a bead catching position when the developer housing is brought into developing position, and to a bead releasing position when the developer is removed from developing position and the magnet is removed from its position adjacent the bead catch. When the bead catch is in bead catching position, the magnet is supported so that removed beads are collected at the bead catch by the magnetic force. When the magnet is removed from that position, there is no longer a magnetic force attracting beads to the bead catch, and the movement of the bead catch to a bead release position allows collected beads to fall to a storage location.

21 Claims, 4 Drawing Sheets

ELECTROPHOTOGRAPHIC DEVICE WITH A BEAD PICKOFF ARRANGEMENT

Figure 1:
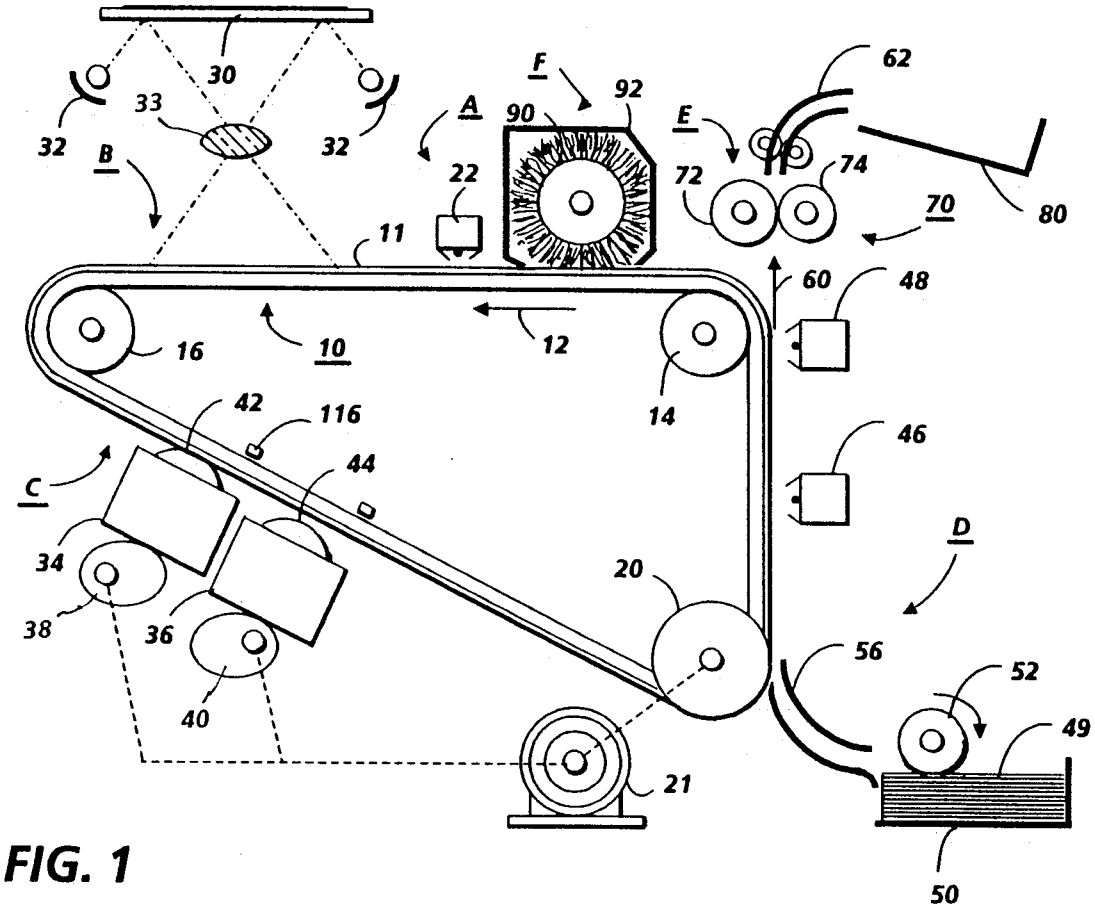

This invention relates to reproduction apparatus, and more particularly, to an electrophotographic device having a removal or pickoff device for removing carrier beads from the developer mix used to develop latent images which adhere to a charge retentive surface in the apparatus during development.

BACKGROUND OF THE INVENTION

In electrophotographic applications such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways. Imaging systems using imagewise ion projection to a charge retentive surface to form an electrostatic latent image developable with toner operate similarly.

Developing material commonly used in systems for developing latent images on the charge retentive surface typically comprises a mixture of toner and a "carrier" of larger granular beads of a magnetic material. If the developing system is a magnetic brush assembly, magnetizable carrier beads also provide mechanical control for the formation of magnetic brush bristles so that toner can readily be brought into contact with the charge retentive surface. Toner is attracted to the latent image from the carrier beads to form the toner image. In this type of system, some carrier beads inevitably adhere to the charge retentive surface after the image is developed. These adhering carrier beads prevent intimate contact between the substrate and toner image during the transfer step. It is thus essential for optimum operation that carrier beads remaining on the charge retentive surface be removed therefrom. Failure to remove carrier beads from the charge retentive surface results in a characteristic copy quality defect displaying a white area with a black dot in the center within a black area. The hard carrier beads also have tendency to abrade and damage the charge retentive surface if not removed prior to reaching the cleaning zone. The carrier beads also pose a threat of damage to cleaning devices.

Carrier bead removal devices are known, such as for example, U.S. Pat. No. 3,894,513 to Stanley et al. and U.S. Pat. No. 3,834,804 to Bhagat et al., which use a stationary magnet having a cylindrical shell rotating thereabout to remove the ferrous carrier beads from the photoreceptor for deposit in a sump or for return to the developer housing. Other bead pickoff devices are known, such as, for example, U.S. Pat. No. 4,210,397 to Macaluso et al. which suggests the use of an electromagnetic bead collector which is periodically activated for the collection of carrier beads on a non-magnetizable surface, and inactivated for the release of the beads along a return path to the developer housing. However, an electromagnetic bead collector is relatively expensive, costly to implement, and requires a rather large current source. U.S. Pat. No. 4,190,351 to Macaluso et al. shows a bead removal arrangement in which the carrier beads are removed from the photoconductive surface by means of a movable magnet and a fixed non-magnetizable shield mounted in close association between said magnet and the photoconductive surface. During the copying cycle, the magnet is moved adjacent the fixed shield to cause magnetizable articles to be drawn against the shield from the photoconductive surface. After the copying cycle, the magnet is moved away from the fixed shield to withdraw the strong magnetic field from the shield, causing the magnetizable particles to fall from the shield into a collection tray by means of gravity. Magnetic arrangements are known for the removal of magnetic material from a surface, including U.S. Pat. No. 4,552,451 to Yamazaki et al. and JP-A No. 59-94776 to Iwamasa.

It would be highly desirable to simply provide a magnetic member closely associated with the charge retentive surface for the removal of carrier beads therefrom, avoiding the need for moving parts or complex controls to operate a bead removal arrangement. However, it will no doubt be appreciated that over time, carrier beads would accumulate at such a magnetic member, and, unless removed, could cause damage or undesired abrasion of the charge retentive surface. Additionally, it is quite expensive to provide a dedicated bead removal arrangement.

A recent trend towards providing automatically actuable second color development has been noted, in which, for second color development, a second developer housing is provided. Each developer housing in the machine may be automatically brought into and out of operational developing position with respect to the charge retentive surface. The movement of the developer housings into and out of developing position allows selective color development of a portion or the entire of the electrostatic latent image. With movement of the second housing into developing position, the first housing is moved out of position, and vice versa.

SUMMARY OF THE INVENTION

In accordance with the invention there is provided an improved bead removal or pickoff device in an electrophotographic device for removal of carrier beads from a charge retentive surface.

In accordance with one aspect of the invention, in an electrophotographic device having a plurality of processing elements to accomplish reproduction processes, occasional reciprocating motion of a processing element with respect to the charge retentive surface may be used to bring a magnetic field to a bead pickoff position for the collection of carrier beads, and at some later time, remove the field to allow removal of collected beads.

In accordance with one aspect of the invention, a bead pickoff device includes a permanent magnet supported on or by a developer housing of the type which is movable into and out of developing position with respect to the photoreceptor. When the developer housing is moved into developing position, a magnet is correspondingly brought into a position closely adjacent to a carrier bead catch supported closely adjacent to the charge retentive surface. Beads are collected at the bead catch and released upon removal of the magnet from proximity to the bead catch. Thus, the movement of the developer housings, inherent in the operation of the machine, is used to remove the collected carrier beads from the area adjacent the photoreceptor to a position where the beads may then be dispersed to the developer or another storage location.

In accordance with another aspect of the invention, the nonmagnetic bead catch may be supported for movement into a bead catching position when the developer housing is brought into developing position, and to a bead releasing position when the developer is removed from developing position and the magnet is removed from its position adjacent the bead catch. When the bead catch is in bead catching position, the magnet is supported so that beads removed from the charge retentive surface are collected at the bead catch. When the magnet is removed from that position, there is no longer a magnetic force attracting beads to the bead catch, and the movement of the bead catch to a bead release position enhances bead dispersion therefrom.

In accordance with still another aspect of the invention, a focusing piece may be used to control the application of the magnetic field to the extent that with judicious selection, the magnet will not attract beads unless the focusing piece is in proximate position. To this end, the focusing piece may be arranged to move with a processing element in the machine to the effect described above.

Figure 2A:
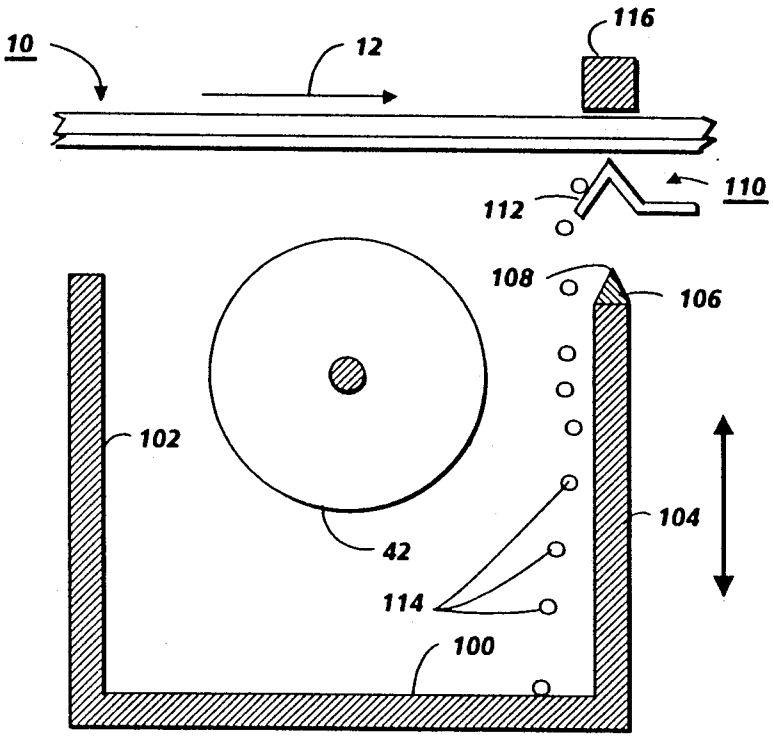
Figure 2:
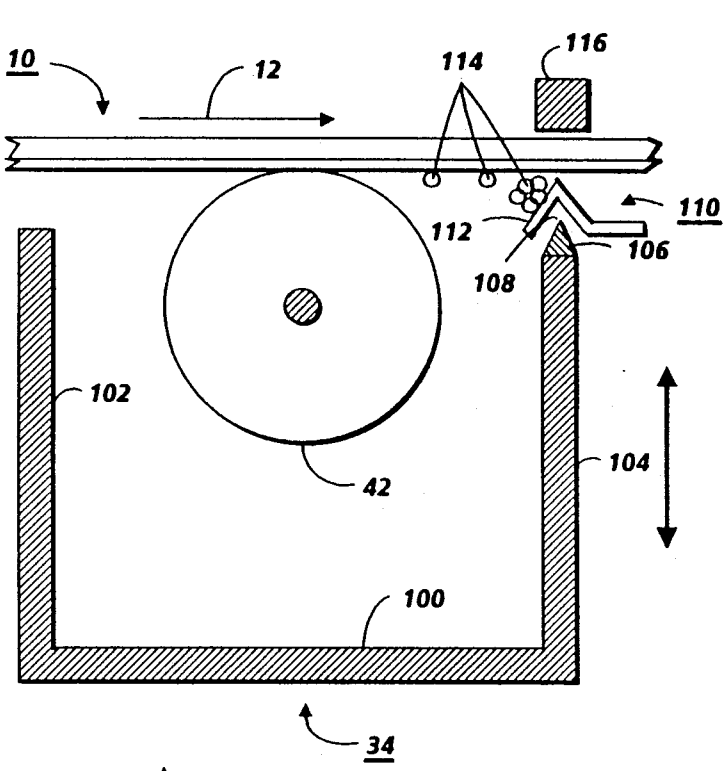
Figure 3A:
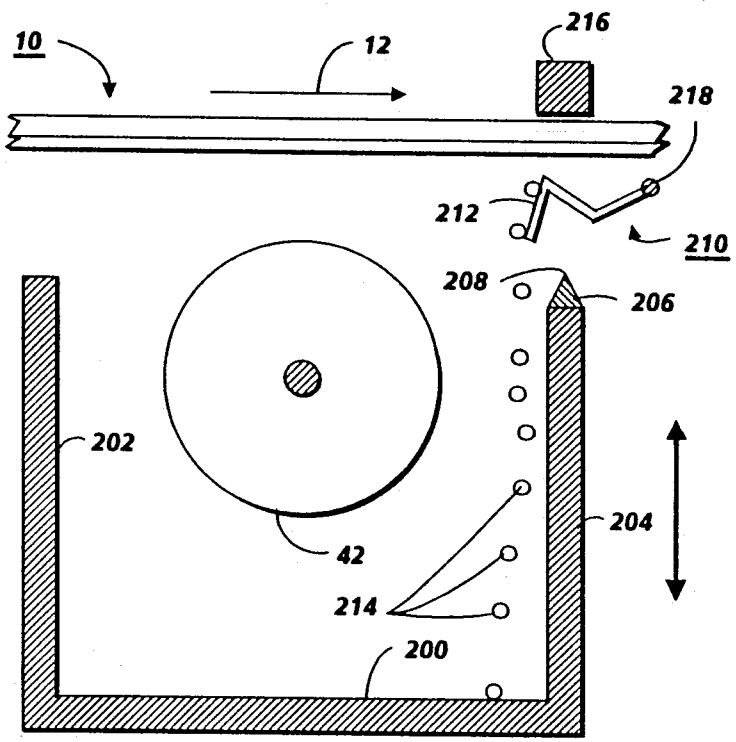
Figure 3:
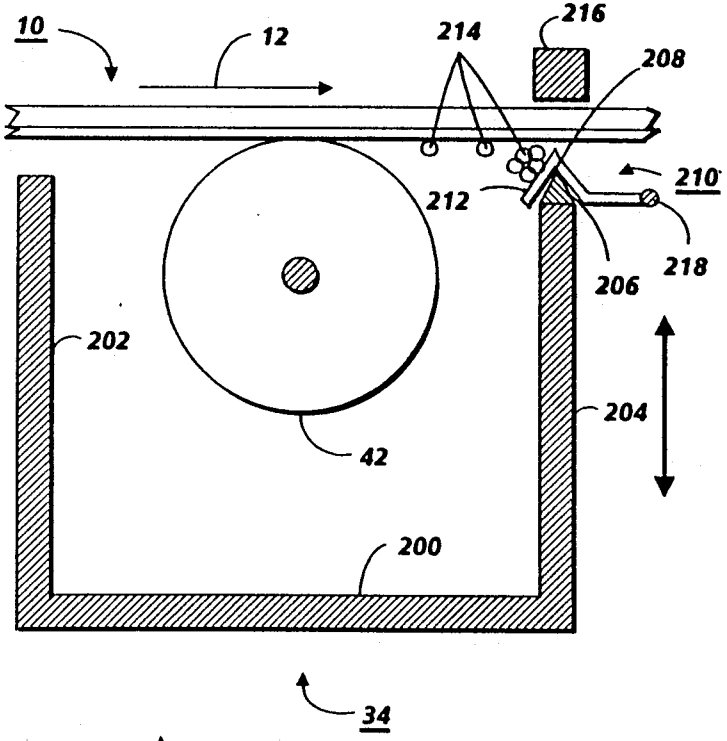
Figure 4:
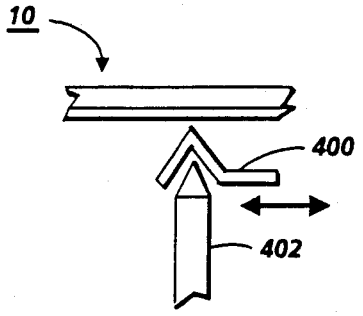
Figure 6:
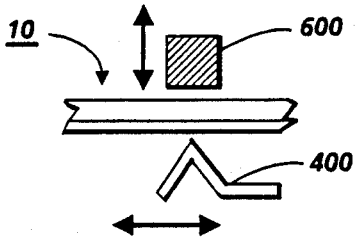
Figure 5A:
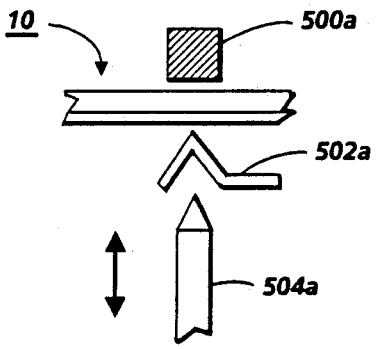

These and other aspects and advantages of the invention will become apparent from the following description used to illustrate a preferred embodiment of the invention read in conjunction with the accompanying drawings in which:

FIG. 1 is a schematic elevational view depicting an electrophotographic printing machine incorporating the present invention;

FIGS. 2 and 2A schematically demonstrate time sequential cross sectional views of the developer housings of an electrophotographic printing machine as shown in FIG. 1, demonstrating one embodiment of the inventive bead pickoff device;

FIGS. 3 and 3A schematically demonstrate time sequential cross sectional views of the developer housings of an electrophotographic printing machine as shown in FIG. 1, demonstrating an alternative embodiment of the invention;

FIG. 4 shows schematically an embodiment of the invention with a permanent magnet member and bead catch;

FIGS. 5A, B, and C show schematically embodiments of the invention with a permanent magnet member, focusing piece and bead catch; and FIG. 6 demonstrates schematically an embodiment of the invention with the bead catch formed from a magnetic material.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original, and with appropriate modifications, to an ion projection device which deposits ions in image configuration on a charge retentive surface. For the purpose of this decription, magnetic member refers to a member formed at least partially from material having ferromagnetic or paramagnetic properties. Permanent magnets, which are ferromagnetic materials, and have a flux field existing when no external field is applied, will be distinguished. Electromagnets may be substitutable for permanent magnets in certain applications.

A reproduction machine in which the present invention finds advantageous use utilizes a photoreceptor belt 10, having a photoconductive surface 11. Belt 10 moves in the direction of arrow 12 to advance successive portions of the belt sequentially through the various processing stations disposed about the path of movement thereof.

Belt 10 is entrained about stripping roller 14, tension roller 16, and drive roller 20. Drive roller 20 is coupled to a motor 21 by suitable means such as a belt drive.

Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a corona device 22 charges photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto a charged portion of photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, belt 10 advances the electrostatic latent image to development station C. At development station C, one of at least two developer housings 34 and 36 is brought into contact with belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system, such as magnetic brush rolls 42 and 44, which provides a rotating magnetic member to advance developer mix (i.e., carrier beads and toner) into contact with the electrostatic latent image. The electrostatic latent image attracts toner particles from the carrier beads, thereby forming toner powder images on photoreceptor belt 10.

Belt 10 then advances the developed latent image to transfer station D. At transfer station D, a sheet of support material such as paper copy sheets is advanced into contact with the developed latent images on belt 10. Corona generating device 46 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet for belt 10, whereupon the sheet is stripped from belt 10 at stripping roller 14.

Sheets of substrate or support material 49 are advanced to transfer station D from a supply tray 50. Sheets are fed from tray 50 with sheet feeder 52, and advanced to transfer station D along conveyor 56. After transfer, the sheet continues to move in the direction of arrow 60 to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets are directed to catch tray 80 or a finishing station for binding, stapling, collating etc., and removal from the machine by the operator. Alternatively, the sheet may be advanced to a duplex tray (not shown) from which it will be returned to the processor and conveyor 56 for receiving second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, may be removed at cleaning station F with rotating brush cleaner 90, within a housing 92. Residual toner may be stored for disposal or returned to the developer for re-use.

As thus described, a reproduction machine in accordance with the present invention may be any of several well known devices. Variations may be expected in specific electrophotographic processing, paper handling and control arrangements without affecting the present invention. It will also no doubt be appreciated that other methods of development of electrostatic images are known with plural developer housings. or the photoreceptor member itself cammable into and out of developing position, some of which require only a single pass through the developer station to develop multiple color images.

In accordance with the invention, and with reference to Figure 2, the inventive bead pickoff device may be advantageously located within developer station C. Exemplary developer housing 34 may be comprised of a container 100 for holding developer material therewithin, with magnetic brush roll 42 journaled for rotating movement within the container to carry developer mix in the container into contact with photoreceptor belt 10. Container 100 extends across photoreceptor belt 10, transverse to the direction of travel thereof, and is generally provided with upstream and downstream walls 102 and 104, respectively. Along wall 104 on the downstream side of container 100, a permanent magnet member 106 is provided along the uppermost portion of wall 104, in close proximity to photoreceptor belt 10. Permanent magnet member 106 is preferably a permanent magnet member having a strength great enough to overcome the electrostatic force holding any carrier beads to photoreceptor belt 10 during development, and may have a generally pointed shape with point 108 at its most proximate to the photoreceptor to better focus the magnetic field at a bead removal point. Interposed between permanent magnet member 106 and photoreceptor belt 10 is located a bead catch 110, supported, for example, on the machine frame (not shown) and desirably a non-permanent magnetic material. Either a non-magnetic material, or a material magnetic only in the presence of another magnet, is suitable. In the described embodiment, permanent magnet member 106 and bead catch 110 have conforming general shapes. Bead catch 110 is provided with bead collecting surface 112, which may be canted somewhat from perpendicular with respect to photoreceptor belt 10 for improved retention of collected carrier beads, shown in the drawing as circles 114. On the opposite side of the photoreceptor from permanent magnet member 106 and bead catch 110 may be a magnetic focusing piece 116, a magnetic member that is not a permanent magnet, located to maximize the magnetic field strength adjacent the bead catch at a selected bead pickoff point. While in the described embodiment, focusing piece 116 is placed on the opposite side of the photoreceptor belt 10 from permanent magnet member 106, it may be located on the same side and in a variety of other positions which serve the purpose of focusing the magnetic fields at a bead pickoff point.

In FIG. 2, developer housing 34 is shown in developing position, closely associated or proximate to photoreceptor belt 10 to bring carrier and toner mix into contact with belt 10 for development of latent electrostatic images thereon. In FIG. 2A, developer housing 34 is shown removed from photoreceptor belt 10 to prevent development by that housing, on the selection of another housing for development for example. In that case, permanent magnet member 106 is removed from proximity to the bead catch 110 and photoreceptor belt 10, removing any magnetic attractive force that there might have been at the bead catch. Accordingly, carrier beads no longer maintained at bead catch 110 by the magnetic attraction of the permanent magnet member 106 fall towards the developer housing. While in the particular embodiment described beads are returned to the developer housing, it will no doubt be appreciated that the beads could easily be dispersed to another storage device.

With reference now to FIG. 3, a similar developer housing 34 and bead catch arrangement is demonstrated, including container 200, with upstream and downstream walls 202, 204, respectively, a permanent magnet member 206 provided along the uppermost portion of wall 204 having a generally triangular cross section coming to a point 208 at its most proximate to the photoreceptor, a non-magnetic bead catch 210, provided with bead collecting surface 212, for retention of collected carrier beads, shown in the drawing as circles 204. On the opposite side of the photoreceptor from permanent magnet member 206 and bead catch 210 may be a magnetic focusing piece 216. In this embodiment, however, bead catch 210 is mounted for pivoting motion about a hinge 218. When the developer housing is in developing position, permanent magnet member 206 impinged upon and biases pivoting bead catch 210 into bead collecting position, and holds the bead catch at position as long as the housing is in developing position. When, as shown in FIG. 3A, the developer housing is removed from developing position, bead catch 210 is no longer supported in bead collecting position, and pivots about hinge 218 to enhance dispersal of the collected carrier beads. Of course, equivalents for the pivotably mounted member may be substituted, such as for example a flexible bead catch, perhaps of a flexible plastic-type material, which is biased into position with permanent magnet member 206, and flexes out of position with removal of the permanent magnet member.

It will no doubt be appreciated that a mechanical carrier bead dispersion element such as a brush or sweep may be provided to improve dispersion of the beads from the bead collecting surface of the bead catch in either of the embodiments described. The movement of the permanent magnet member away from the bead catch may also be arranged to provide a magnetic attraction of the carrier beads during such movement, enhancing their dispersal. It may also be desirable to provide a control arrangement which moves the developer housings away from the photoreceptor belt periodically, whether or not they have been selectively moved recently, in order to guarantee that the carrier beads are periodically dispersed from the bead collecting surface. This may be done during, for example, machine warm-up time.

Other elements of reproduction machines that reciprocate or can provide reciprocation between positions proximate and removed from a charge retentive surface, and desirably located between development and transfer stations along the processing path, may also find use for a bead removal device. Thus, for example, if the particular reproduction device has a paper tray periodically moved to and from proximity with the photoreceptor, a carrier bead attracting the permanent magnet member may be supported on the tray or an extension thereof, for attraction to an interposed bead catch. Subsequent movement of the permanent magnet member out of bead collecting position in accordance with the tray would allow dispersion of the carrier beads to a storage device.

FIGS. 4 and 5 show schematically that the movement of one of either magnet and bead catch, or magnet, focusing piece and bead catch, may be used to create the desired bead removal effect, and subsequently allow removal of the beads from the collection point. FIG. 4 shows how movement of the bead catch 400 with respect to the photoreceptor 10 and permanent magnet member 402 can be used to the described effect. Once removed from proximity to the magnet, beads can easily be removed from the bead catch.

Figure 5B:
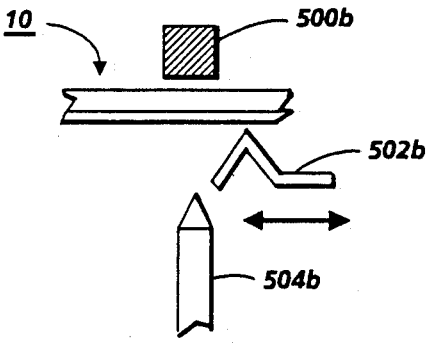
Figure 5C:
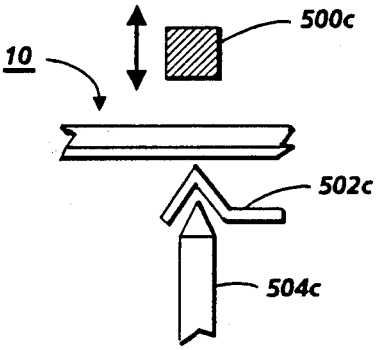

FIG. 5 demonstrates potential permutations of the combination of focusing piece 500, bead catch 502 and permanent magnet member 504, with the magnet selected to have a force sufficient to remove beads only when it is proximate a focusing piece. As shown, in FIGS. 5A, 5B, 5C, with this selection of the materials and positioning, any of the three members, focusing piece 500, bead catch 502 or magnet 504, or combinations thereof, may be used for bead removing effect, as previously described in the embodiments of FIGS. 2 and 3. Particularly with respect to FIG. 5C, which shows movement of the focusing piece to effect bead pickoff, it will no doubt be appreciated that this movement could be caused by movement of one or the other of the developing housings. For example, permanent magnet member 504c and bead catch 502c could be fixedly mounted with respect to a frame of a machine, and the focusing piece could be mounted on one of the movable developer housings. When a first developer housing moves out of developing position, it would naturally carry the focusing piece into operational position with respect to the magnet and bead catch. Of course, as described in previous embodiments, combinations of motion are within the scope of the invention as well.

From the embodiments as shown in FIG. 5, one will no doubt appreciate that substitutions of material are also possible among the elements. Thus, the focusing piece could be in the position of the magnet and the magnet in the position of the focusing piece.

With reference to FIG. 6, a two member bead removal arrangement is again shown, this time with either the focusing piece 600 or the bead catch 602, or the combination thereof in movement. Both may be magnetic members, with either a permanent magnet. When they are moved to the appropriate positioning with respect to one another, they produce the requisite bead removal force.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

We claim:

1. Reproduction apparatus including a charge retentive surface; an image forming station for forming a latent image on the charge retentive surface; at least one developer housing supporting developing means for developing the latent image with a toner and carrier bead mix, the developer housing reciprocally movable to and from a developing position with respect to the charge retentive surface; a transfer station; and a carrier bead removal device removing carrier beads adhering to the charge retentive surface after development, said carrier bead removal device comprising:

a bead catch supported closely adjacent to said charge retentive surface having a bead supporting surface for the collection of carrier beads;

a magnetic member supported for reciprocating movement with the developer housing, between a position proximate said bead catch and a position removed from said bead catch, said proximate position providing a magnetic field at said bead catch for the removal of carrier beads from the charge retentive surface and collection at said bead supporting surface, and said removed position allowing carrier beads to be dispersed from said bead catch.

2. The apparatus as defined in claim 1, wherein said bead catch is biasable to bring said bead supporting surface into position for the collection of carrier beads when said magnetic member is at said proximate position, and out of position for the collection of carrier beads when said magnetic member is at said removed position to enhance dispersal of carrier beads.

3. The apparatus as defined in claim 1 wherein said bead supporting surface is canted from perpendicular with respect to the charge retentive surface, in the direction of photoreceptor travel.

4. The apparatus as defined in claim 1, wherein said magnetic member is generally pointed, with an apex directed towards said charge retentive surface.

5. The apparatus as defined in claim 1, including a magnetic focusing member to focus the magnetic field at a selected bead removal point.

6. The apparatus as defined in claim 5, wherein said magnetic member is generally pointed, with an apex directed towards said magnetic focusing member.

7. Reproduction apparatus including a charge retentive surface; an image forming station for forming a latent image on the charge retentive surface; at least one developer housing supporting developing means for developing the latent image with a toner and carrier bead mix, the developer housing reciprocally movable to and from a developing position with respect to the charge retentive surface; a transfer station; and a carrier bead removal device removing carrier beads adhering to the charge retentive surface after development, said carrier bead removal device comprising:

a magnetic member supported for reciprocating movement with the developer housing, between a position proximate the charge retentive surface and a position removed from the charge retentive surface, said proximate position providing a magnetic field for the removal of carrier beads from the charge retentive surface; and a bead catch interposed at a fixed location between said magnetic member and the charge retentive surface, having a bead supporting surface for the collection of carrier beads when said magnetic member is at said proximate position and dispersal of said carrier beads when said magnetic member is at said removed position.

8. The apparatus as defined in claim 7, wherein said bead catch is pivotably supported at said fixed location to pivot said bead supporting surface to a first orientation for the collection of carrier beads when said magnetic member is at said proximate position, and to a second orientation for the enhancement of dispersal of carrier beads when said magnetic member is at said removed position.

9. The apparatus as defined in claim 7, wherein said magnetic member is generally pointed with an apex directed towards said charge retentive surface.

10. The apparatus as defined in claim 7, including a magnetic focusing member arranged on the opposite side of the charge retentive surface from said magnetic member, to focus the magnetic field at a selected bead removal point.

11. The apparatus as defined in claim 10, wherein said magnetic member is generally pointed, with an apex directed towards said magnetic focusing member.

12. Reproduction apparatus including a charge retentive surface moving along a processing path; an image forming station for forming a latent image on said charge retentive surface; at least one developer housing supporting developing means for developing the latent image with a toner and carrier bead mix, and forming an enclosure for containing the mix, with upstream and downstream walls transverse to the direction of movement of, and extending across the charge retentive surface; the developer housing reciprocally movable to and from a developing position with respect to the charge retentive surface; a transfer station; and a carrier bead removal device removing carrier beads adhering to the charge retentive surface after development, said carrier bead removal device comprising:

a magnetic member fixedly supported on the downstream wall of the developer housing, and moving with the developer housing between a position proximate to the charge retentive surface for the removal of carrier beads therefrom and a position removed from the charge retentive surface; and a bead catch interposed at a fixed location between said magnetic member and the charge retentive surface, having a bead supporting surface for the collection of removed carrier beads when said magnetic member is at said proximate position, and dispersal of said carrier beads when said magnetic member is at said removed position.

13. The apparatus as defined in claim 12, wherein said bead catch is biasable to bring said bead supporting surface into position for the collection of carrier beads when said magnetic member is at said proximate position, and out of position for the collection of carrier beads when said magnetic member is at said removed position to enhance dispersal of carrier beads.

14. The apparatus as defined in claim 12, wherein said bead catch is pivotably supported at said fixed location to pivot said bead supporting surface to a first orientation for the collection of carrier beads when said magnetic member is at said proximate position, and to a second orientation for the enhancement of dispersal of carrier beads when said magnetic member is at said removed position.

15. The apparatus as defined in claim 12 wherein said bead supporting surface is canted from perpendicular with respect to the charge retentive surface, in the direction of photoreceptor travel.

16. The apparatus as defined in claim 12, wherein said magnetic member is generally pointed, with an apex directed towards said charge retentive surface.

17. The apparatus as defined in claim 12, including a magnetic focusing member arranged to focus the magnetic field at a selected bead removal point.

18. The apparatus as defined in claim 17, wherein said magnetic member is generally pointed, with an apex directed towards said magnetic focusing member.

19. Reproduction apparatus having a plurality of elements for the formation and development of electrostatic images on a charge retentive surface, and transfer of the developed electrostatic images to a substrate, including means for developing said electrostatic images with a toner and carrier bead mix, at least one of said elements reciprocating between a position proximate to the charge retentive surface and a position removed therefrom, and a carrier bead removal device for removal of carrier beads adhering to said charge retentive surface after development, said carrier bead removal device comprising:

a magnetic member associated with said at least one element, and supported for movement therewith between a position proximate to the charge retentive surface and a position removed therefrom, and having a magnetic field attracting carrier beads from said charge retentive surface;

a non-magnetic bead catch interposed at a fixed location between said magnetic member and the charge retentive surface, having a bead supporting surface for the collection of removed carrier beads when said magnetic member is at said proximate position, and dispersal of said carrier beads when said magnetic member is at said removed position.

20. Reproduction apparatus having a plurality of elements for the formation and development of electrostatic images on a charge retentive surface, and transfer of developed electrostatic images to a substrate, including a developing station for developing the electrostatic image with a toner and carrier bead mix; at least one of said elements reciprocating between a position proximate to the charge retentive surface and a position removed therefrom; and a carrier bead removal device for removal of carrier beads adhering to said charge retentive surface after development, said carrier bead removal device comprising:

first and second magnetic members, at least said first magnetic member a permanent magnet, and said second magnetic member a magnetic focusing piece, said first and second members in combination providing a magnetic field with magnitude and direction suitable for the removal of beads from the charge retentive surface;

at least one of said first and second magnetic members asociated with the at least one reciprocating element, and supported for movement therewith between a position proximate to the charge retentive surface and a position removed therefrom, a bead catch interposed between said first magnetic member and said charge retentive surface, having a bead supporting surface for the collection of removed carrier beads when said at least one of said first and second magnetic members is at said proximate position, and dispersal of said carrier beads when said at least one of said first and second magnetic members is at said removed position.

21. Reproduction apparatus having a plurality of elements for the formation and development of electrostatic images on a charge retentive surface, and transfer of developed electrostatic images to a substrate, including a developing station for developing the electrostatic image with a toner and carrier bead mix; at least one of said elements reciprocating between a position proximate to the charge retentive surface and a position removed therefrom; and a carrier bead removal device for removal of carrier beads adhering to said charge retentive surface after development, said carrier bead removal device comprising:

first and second magnetic members, at least said first magnetic member a permanent magnet, and said second magnetic member a magnetic focusing piece, said first and second members in combination providing a magnetic field with magnitude and direction suitable for the removal of beads from the charge retentive surface;

at least one of said first and second magnetic members associated with the at least one reciprocating element, and supported for movement therewith between a position proximate to the charge retentive surface and a position removed therefrom, one of said first and second magnetic members having a bead supporting surface for the collection of removed carrier beads when said at least one of said first and second magnetic members is at said proximate position, and dispersal of said carrier beads when said at least one of said first and second magnetic members is at said removed position.

* * * * *